United States Patent [19]

Nakayama et al.

[11] Patent Number: 4,476,356

[45] Date of Patent: Oct. 9, 1984

[54] MULTI-POSITION ELECTRICAL SWITCH

[75] Inventors: Kiyoshi Nakayama; Tadayoshi Muto, both of Shizuoka, Japan

[73] Assignee: Murakami Kaimeido Co., Ltd., Shizuoka, Japan

[21] Appl. No.: 533,296

[22] Filed: Sep. 19, 1983

Related U.S. Application Data

[63] Continuation-in-part of Ser. No. 434,519, Oct. 15, 1982.

[30] Foreign Application Priority Data

Oct. 16, 1981 [JP] Japan ..... 56-152866

[51] Int. Cl.[3] ..... H01H 13/70

[52] U.S. Cl. ..... 200/6 A; 200/153 K; 200/264

[58] Field of Search ..... 200/6 A, 153 K, 264

[56] References Cited

U.S. PATENT DOCUMENTS

| | | | |
|---|---|---|---|
| 1,426,193 | 8/1922 | Holmgren | 200/153 K |
| 2,857,485 | 10/1958 | Brooks | 200/6 A |
| 4,029,915 | 6/1977 | Ojima | 200/340 |
| 4,317,012 | 2/1982 | Itoh | 200/264 |
| 4,324,472 | 4/1982 | Terada et al. | 200/264 |
| 4,349,708 | 9/1982 | Asher | 200/6 A |
| 4,368,369 | 1/1983 | Matsumoto et al. | 200/264 |
| 4,401,864 | 8/1983 | Ichikawa | 200/153 K |
| 4,408,103 | 10/1983 | Smith | 200/6 A |

FOREIGN PATENT DOCUMENTS

| | | | |
|---|---|---|---|
| 2368790 | 10/1976 | France | 200/153 K |
| 5671428 | 5/1981 | Japan . | |

*Primary Examiner*—John W. Shepperd
*Assistant Examiner*—Renee S. Kidorf

[57] ABSTRACT

A multi-position switch suitable for use as a remote control switch for electrically operated rearview mirrors of a motor vehicle. The switch of the invention comprises fixed contact components in the form of printed circuits disposed on an insulating base plate, a pressure-sensitive conductive rubber sheet (which becomes conductive only when and where it is pressed) being laid over the fixed contact components, whereby the fixed contact components and the rubber sheet forming switch elements, and an operating button adapted to be tilted with respect to the rubber sheet and having a tendency to return to its original position. Therefore, the switch of the invention can have a flat, thin shape. Also, the switch is easy to assemble and has satisfactory reliability because it consists of a small number of component parts. Furthermore, the operating button is adapted to have a tilting stroke and make clicks, so that the switch of the invention is easy to use and gives a reassuring feeling of use.

6 Claims, 11 Drawing Figures

MULTI-POSITION ELECTRICAL SWITCH

This application is a continuation-in-part of our copending U.S. patent application, Ser. No. 434,519, filed Oct. 15, 1982.

BACKGROUND OF THE INVENTION

1. Field of the Invention

The present invention relates to a switch suitable for use as a remote control switch for electrically operated rearview mirrors of a motor vehicle. More particularly, the invention relates to a switch having switch elements comprising a pressure-sensitive rubber sheet which becomes conductive only when and where it is pressed (hereinafter referred to as a "pressure-sensitive conductive rubber sheet" or a "rubber sheet".

Each of a pair of electrically operated rearview mirrors mounted on a door, a fender or the like, of a motor vehicle contains two electric motors, etc. in its driving section, said electric motors, etc. being controlled by means of a switch inside the vehicle so as to adjust the direction of inclination, horizontal or vertical, of each mirror. The switch for controlling the electrically operated rear view mirrors is required to have the functions of actuating each of said two electric motors of each mirror independently, and of changing the polarity of the electric power supplied thereto.

2. Description of the Prior Art

To meet the above requirements, Kiyoshi Nakayama, one of the inventors, has invented a switch which, as disclosed in Japanese Utility Model application No. Sho 56-71428, comprises a housing, an operating member disposed within said housing at a certain clearance from the inner walls of said housing, said operating member being adapted to swing from its neutral position in four directions meeting at right angles with one another, two switch elements disposed between said operating member and each of the four inner walls of said housing, each of said switch elements comprising a pair of electrodes and a pressure-sensitive conductive rubber sheet disposed therebetween, said switch elements being adapted to change the polarity of the electric power supply.

However, the disclosed switch has a deep shape and cannot be made small because the operating member is swingably disposed within the housing and the switch elements are disposed between the operating member and the four inner walls of the housing. Also, the switch is not very easy to assemble. Furthermore, it does not give a reassuring feeing of use because the operating member has almost no stroke and does not click at all.

U.S. Pat. No. 4,324,472, K. Terada et al. This patent discloses a camera switch for an electrical shutter which can be operated with a soft touch. The switch is made up of an electrode base formed of a flexible printed circuit board, a pressure-sensitive conductive rubber sheet element overlying the printed circuits, and a button with a plurality of projections on its bottom surface. By pressing the button the sheet element is selectively compressed to close the shutter circuit.

U.S. Pat. No. 4,029,915, S. Ojima, describes a keyboard for an electronic computer which keyboard includes a printed circuit board, a contact holder formed of a flexible insulating film and having movable contacts, and keys perpendicular to the printed circuit board but supported to be tilted in a plurality of directions. Four types of switch elements can be selectively actuated by pressing the keys. This structure assumes that any given key is properly tilted when it is depressed.

U.S. Pat. No. 2,857,485, R. Brooks, discloses a multi-position electric switch which through an operating lever, manipulates a wobble disc electrical contact.

The prior art patents do not give any consideration to the problems which arise when a key is incorrectly tilted, as when the corner of a key is depressed, or tilted obliquely, or when two respective switch elements simultaneously could be closed to an ON state.

BRIEF SUMMARY OF THE INVENTION

It is therefore an object of the invention to provide a switch which has obviated all the disadvantages of the prior art. This object has been attained by a switch comprising fixed contact components disposed on an insulating base plate, a pressure-sensitive conductive rubber sheet laid over said fixed contact components, said fixed contact components and said pressure-sensitive conductive rubber sheet forming switch elements, and an operating button adapted to be tilted with respect to said pressure-sensitive conductive rubber sheet and having a tendency to return to its original position.

This and other objects and advantages of the invention will appear more fully from the following description.

DESCRIPTION OF THE DRAWINGS

FIG. 1 is a plan view of the same.

FIG. 2 is a sectional view taken on line II—II of FIG. 1.

FIG. 3 is a plan view of a supporting plate.

FIG. 4 is a bottom view of an operating button.

FIG. 5 is a sectional view taken on line V—V of FIG. 1.

FIG. 6 is a bottom view of a slide block.

FIG. 7 is an enlarged plan view of a printed circuit.

FIG. 8 is a plan view schematically illustrating the arrangement of switch elements in said printed circuit.

FIG. 9 is a circuit diagram illustrating the relations between said switch elements, etc.

FIG. 10 is an enlarged sectional view illustrating a ball-and-socket joint.

FIG. 11 is an enlarged sectional view illustrating the operation of said joint.

DETAILED DESCRIPTION

Figure 1:
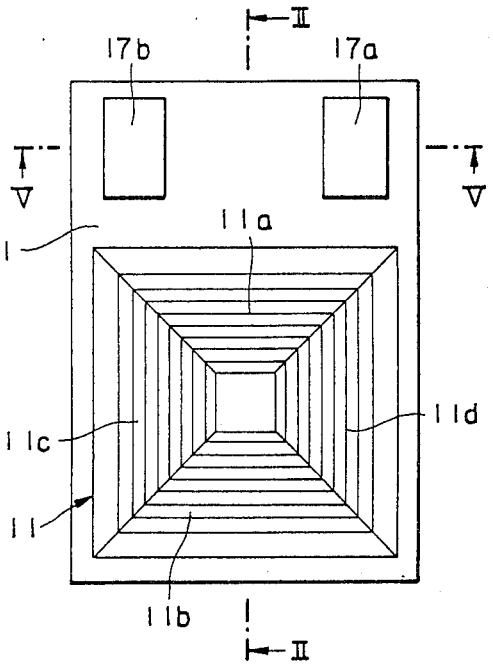
FIGS. 1 to 11 illustrate an embodiment of the invention.

The present invention will now be described in detail, with reference to an embodiment illustrated in the drawings.

Numeral 1 represents a housing. Numeral 2 represents an electric insulating base plate of a printed circuit, which plate also serves as a bottom plate of the housing 1. Disposed within the housing 1 is a power source polarity changing switch S1 and another switch S2 for changeover between a right-hand mirror R and a left-hand mirror L.

Figure 9:
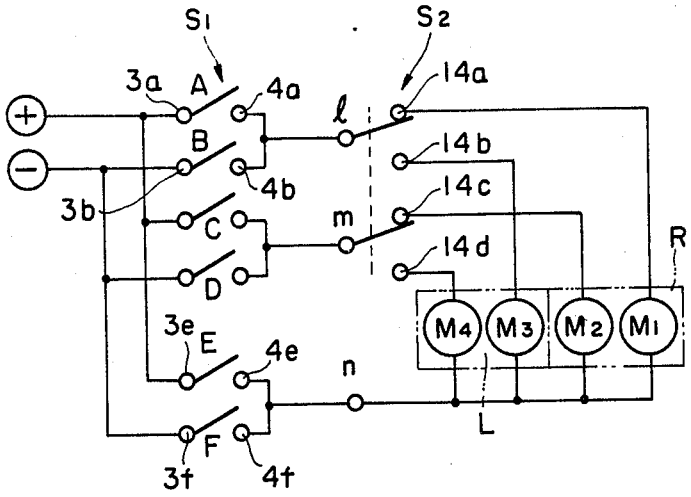

First, the switch S1 will be described in detail. The switch S1 comprises, for example, six switch elements A to F as shown in FIG. 9. Six pairs of printed circuit electrodes 3*a* and 4*a* to 3*f* and 4*f*, serving as fixed contact components of the switch elements A to F, are printed on the base plate 2 so that each pair of electrodes is opposed to each other like comb teeth engaged with each other. The complete set of printed circuit electrodes 3*a* and 4*a* to 3*f* and 4*f* cover an approximately square area on the base plate 2. See FIG. 7.

A pressure-sensitive conductive rubber sheet 5, corresponding to a movable contact of a conventional switch element, is laid over said fixed contact components. The single rubber sheet 5 is common to all the fixed contact components. The pressure-sensitive conductive rubber sheet 5 is made of silicone rubber ahd metal particles, for example. It is usually nonconductive and becomes conductive according to the pressure applied thereto.

Figure 8:
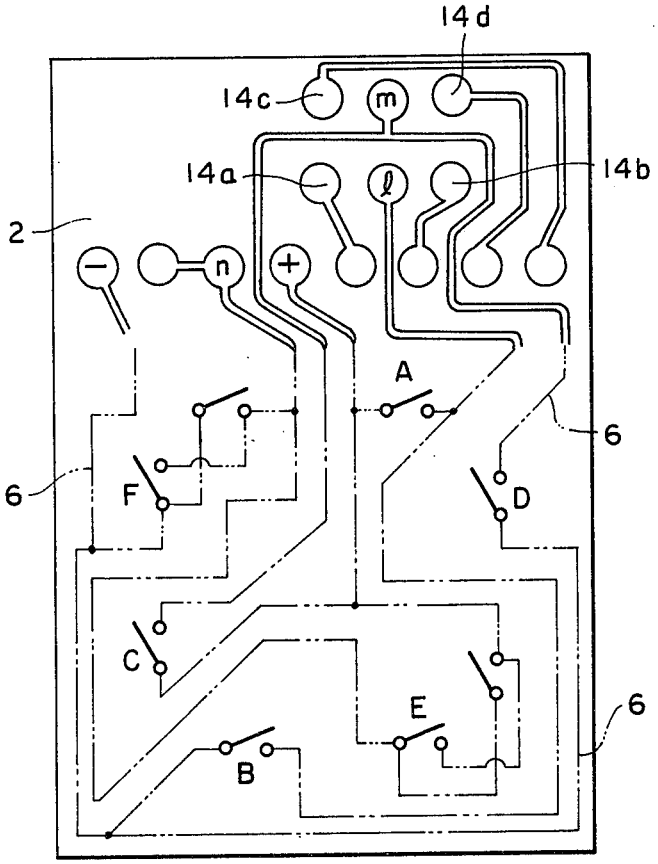

Thus, according to the present invention, the six switch elements A to F are disposed on the surface of the base plate 2 and they are connected by printed conductors 6 so as to form two switch means for changing the polarity of the electric power source. That is, in FIG. 9, the four switch elements, A, B, E and F form one switch means (switch means for vertical adjustment) and the four switch elements C, D, E and F form the other switch means (switch means for horizontal adjustment). The two switch elements E and F are common to both of the switch means. The arrangement of the switch elements A to F on the base plate 2 is illustrated in FIG. 8.

Operating means as follows are disposed over said elements A to F.

Figure 2:
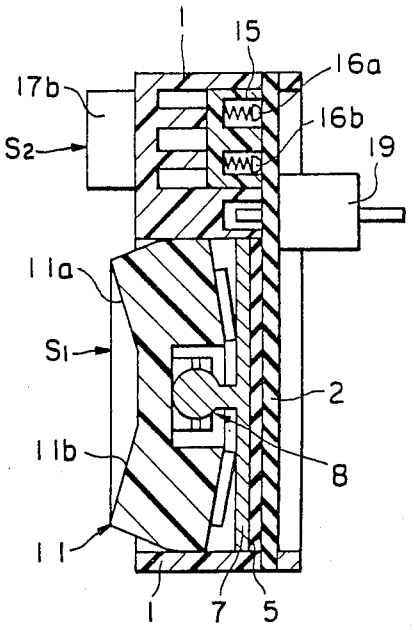
Figure 3:
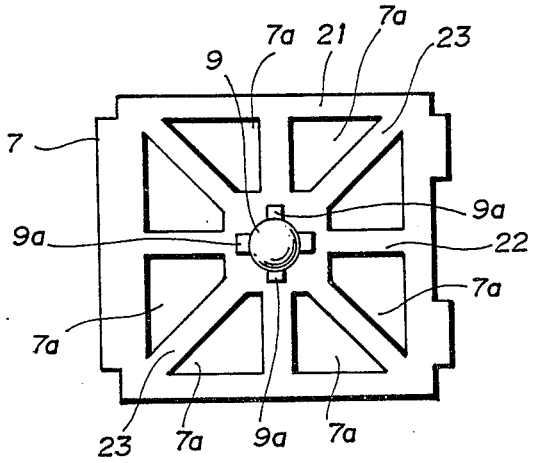
Figure 4:
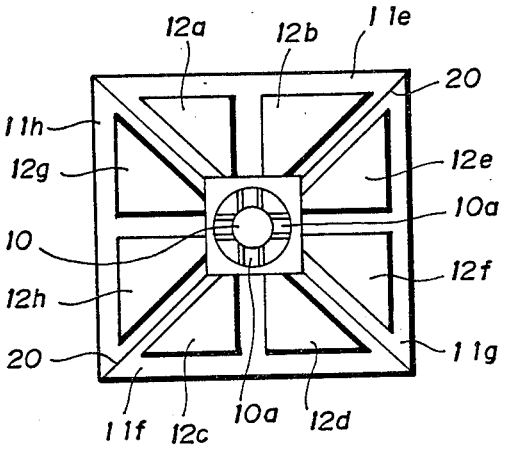

First, a supporting plate 7 as shown in FIG. 3, formed of an electrically insulating material, is disposed on top of the rubber sheet 5. The supporting plate 7 is fixed at its periphery to the housing 1. And an operating button 11 is supported on a ball-and-socket joint 8 provided approximately in the center of the supporting plate 7 so that the operating button 11 can be tilted with respect to the rubber sheet 5. The operating button 11 has a square shape, for example, in its plan view as shown in FIG. 1, and is adapted to press the rubber sheet 5 separately when any of its four portions, that is, an upper portion 11*a*, lower portion 11*b*, left portion 11*c* and right portion 11*d* in FIG. 1, is pushed. As shown in FIGS. 2 to 4, the section of the operating button 11 facing the pressure-sensitive conductive rubber sheet 5, that is, the lower part of the button, has the shape of a frustum of a pyramid with its vertex on the vertical axis of said ball-and-socket joint 8 which serves as a point of support, and has four faces 11*e*, 11*f*, 11*g* and 11 *h*, as well as four corner lines 20 where the faces meet. Each of the four sloping faces 11*e* to 11*h* of said frustum of a pyramid has two pressing surfaces, 12*a* and 12*b*, 12*c* and 12*d*, etc. slightly protruding therefrom. These pressing surfaces 12*a* to 12*h* correspond to said switch elements A to F as follows: The pressing surface 12*a* corresponds to the switch element A, the pressing surface 12*b* to the switch element F, the pressing surface 12*c* to the switch element B, the pressing surface 12*d* to the switch element B, and so on. Thus, each of the four sloping faces 11*e* to 11*h* of said frustum of a pyramid corresponds to two switch elements.

Said supporting plate 7, formed of an electrical insulating material, has as shown in FIG. 3, a ball 9, which will be described in detail later, upwardly projecting at the center, and has eight trapezoid-shaped openings 7*a* spaced radially about the plate. The trapezoid-shaped openings 7*a*, are surrounded by the periphery 21 of the supporting plate 7, cross member 22 formed in a narrow width from the center toward the periphery and diagonal members 23. Further, a pair of openings 7*a* and 7*a*, which form the shape of a trapezoid symmetrical to the respective periphery, cross and diagonal members, correspond to the pressing surfaces 12*a*, 12*b*, . . . , 12*h* which protrude from the bottom section of the operating button. Therefore, when any of the pressing positions 11*a*, 11*b* . . . 11*d* of the operating button is depressed, only a pair of pressing surfaces at the depressed position are engaged with the facing openings 7*a* and 7*a*. For example, when the pressing position 11*a* is depressed, the protruding, pressing surfaces 12*a* and 12*b* of the face 11*e* engage with the facing openings, and when the pressing position is, accordingly, further depressed, thereby pressing the pressure-sensitive conductive rubber sheet 5 at the position, the switch elements A and F at the corresponding positions are, in turn, switched to the ON state.

Said ball-and-socket joint 8 supporting said operating button 11 comprises a ball 9 attached to the supporting plate 7 and a socket 10 provided in the operating button 11. The ball 9 has pins 9*a* protruding crosswise toward the bottom section of said button. The socket 10 has grooves 10*a* corresponding to the pins 9*a*, said grooves 10*a* being elastic and slightly narrower than the diameter of the pins 9*a*. The elastic grooves 10*a* and the pins 9*a* give the operating button 11 a tendency to return to its neutral, untilted, position.

Figure 5:
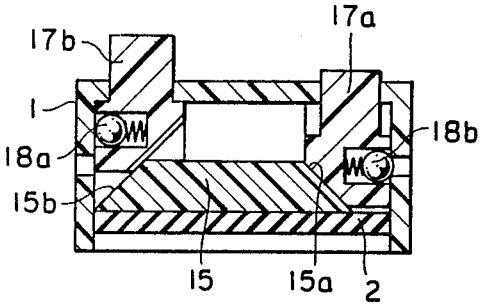
Figure 6:
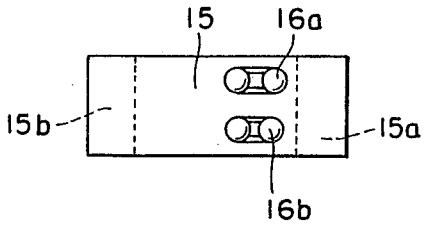
Figure 7:
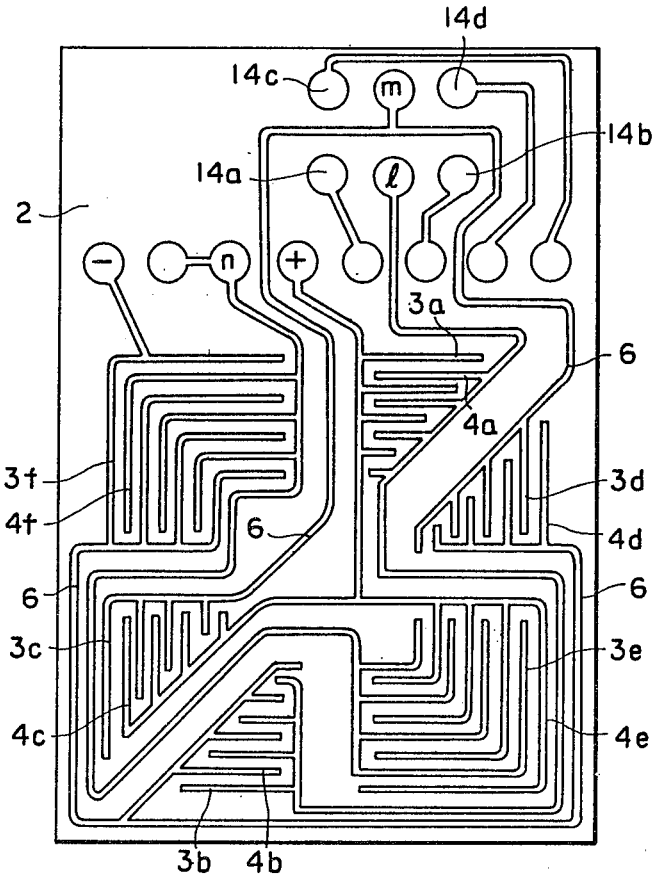

Reference will now be made to the switch S2 for selectively connecting the above-mentioned switch S1 with either the right-hand mirror R or the left-hand mirror L. The switch S2 comprises two circuits and six contacts. Contact patterns l, m and 14*a* to 14*d*, corresponding to the six contacts, are printed near one end (upper portion in FIG. 7) of the base plate 2. A slide block 15, slidable right and left in FIGS. 5 or 7, is disposed over the contact patterns l, m and 14*a* to 14*d*. The slide block 15 is provided with movable contacts 16*a* and 16*b* corresponding to the contact patterns l, m and 14*a* to 14*d*. A pair of push buttons 17*a* and 17b respectively corresponding to the right-hand mirror R and the left-hand mirror L are disposed on both sides of the slide block 15 in the direction of its slide. The driving end of each push button is engaged with one of the tapered portions 15*a* and 15*b* formed on opposite ends of the slide block 15. Numerals 18*a* and 18*b* represent balls for positioning the push buttons 17*a* and 17*b*.

Thus, the embodiment illustrated in the drawings is a hybrid switch comprising said switch S1 including the six switch elements A to F and said changeover switch S2.

Numeral 19 in FIG. 2 represents a connector for connecting the contacts l, m and 14*a* to 14*d* in the changeover switch S2 with the rearview mirrors R and L. Referring to FIG. 9, Symbol M1 represents an electric motor for vertically adjusting the right-hand mirror R, symbol M2 representing an electric motor for horizontally adjusting the right-hand mirror R, symbol M3 representing an electric motor for vertically adjusting the left-hand mirror L, and symbol M4 representing an electric motor for horizontally adjusting the left-hand mirror L.

The operation of the switch of the invention will now be described.

Reference will be made to the case of controlling the right-hand mirror R by pushing the push button 17*a* of the changeover switch S2. When the push button 17*a* is pushed, the slide block 15 is slid toward the left in FIG. 5 and its movable contacts 16*a* and 16*b* respectively close the contacts l and 14*a* together and the contacts m and 14*c* together so that the switch S1 is connected with the right-hand mirror R. (See FIG. 9.)

Figure 10:
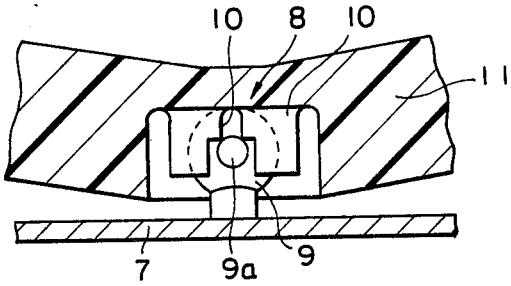
Figure 11:
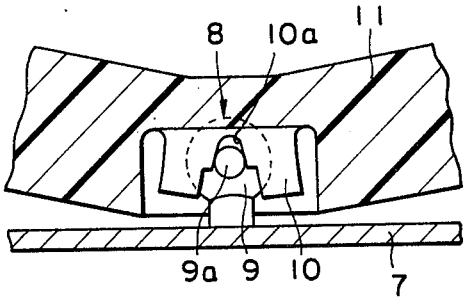

When face 11*a* of the operating button 11 is pushed thereafter for a certain period of time, the switch elements A and F are respectively closed and the electric motor M1 rotates in such a direction as to change the angle of the right-hand mirror R upward. At this time, a corresponding pin 9*a* of the ball-and-socket joint 8 is forced into a corresponding groove 10*a* as shown in FIG. 11. When the operator stops pushing the operating button 11, the pin 9*a* is pushed out of the groove 10*a* by the elasticity thereof and returns to its neutral position as shown in FIG. 10. Such engagement and disengagement of the pin 9*a* with the groove 10*a* cause the operating button 11 to click.

When face 11*b* of the operating button 11 is pushed, the switch elements B and E are respectively closed and the electric motor M1 rotates in a reversed direction so as to change the angle of the right-hand mirror R downward.

When face 11*c* of the operating button 11 is pushed, the switch elements C and F are respectively closed and the electric motor M2 rotates in such a direction as changes the angle of the right-hand mirror R toward the left.

When face 11*d* of the operating button 11 is pushed the switch elements D and E are respectively closed and the electric motor M2 rotates in a reversed direction so as to change the angle of the right-hand mirror R toward the right.

The operation of the ball-and-socket joint 8 when face 11*b*, 11*c* or 11*d* of the operating button 11 is pushed is the same as when face 11*a* thereof is pushed.

When the push button 17*b* of the changeover switch S2 is pushed, the left-hand mirror L is controlled in the same way as mentioned above.

As described above, when any of the pressing faces 11*a*, 11*b*, . . . , 11*d* of the operating button 11 is depressed, the pressing surface is engaged with the corresponding openings 7*a* thereby pressing the pressure-sensitive conductive rubber sheet 5. Accordingly, the switch element corresponding to the pressing position is turned ON. In the case where the corner at the pressing position of the operating button 11 is depressed, thereby obliquely operating it, the corner line 20 of the pyramid frustum makes contact with the diagonal member 23 of the supporting plate 7 before the pressing surface engages the openings, with the result that the pressing surface cannot be depressed any further. Consequently, the pressure-sensitive conductive rubber sheet 5 is not pressurized. In other words, when the oblique depression is performed the pressing operation of the rubber sheet is not performed, and accordingly, no switch element is turned ON, thereby completely preventing the short circuiting erroneous operation.

Thus, according to the present invention, the fixed contact components each consisting of a pair of printed circuit electrodes are disposed on the insulating base plate, the pressure-sensitive conductive rubber sheet being laid over said fixed contact components, said fixed contact components and said rubber pressure-sensitive conductive sheet forming the switch elements, and the operating button for operating said switch elements being adapted to be tilted with respect to said pressure-sensitive conductive rubber sheet and having a tendency to return to its original position. Therefore, the switch of the invention can have a flat and thin shape. Also, the switch is easy to assemble and has satisfactory reliability because it consists of a small number of component parts. Consequently, the switch is suitable for use as a remote control switch for electrically controlled rearview mirrors of a motor vehicle.

Furthermore, according to the embodiment of the present invention, the operating button has the shape of the frustum of a pyramid, with its vertex at the point of support thereof, each of the faces of said pyramidal shape having pressing surfaces, said point of support being the ball-and-socket joint having the pins and the elastic grooves. Therefore, the operating button has a tilting stroke and makes clicks. Thus, the switch of the invention is easy to use and gives a reassuring feeling of use.

As many apparently widely different embodiments of this invention may be made without departing from the spirit and scope thereof, it is to be understood that the invention is not limited to the specific embodiment thereof except as defined in the appended claims.

What is claimed is:

1. A multi-position electrical switch comprising:

a housing an electrical insulating base plate disposed in the bottom of said housing, printed circuit electrodes arranged on said base plate so that a pair of electrodes is respectively disposed on each side of a rectangle, a pressure-sensitive conductive rubber sheet laminated on the upper portion of said printed circuit electrodes and forming power source polarity changing switches by contacting and pressing said electrodes, a supporting plate disposed over said rubber sheet, having a ball of a ball-and-socket joint at the center thereof and having a plurality of openings therein, an operating button disposed in a space surrounded by said housing and tiltably mounted on said ball, the section of said operating button facing said supporting plate being formed in the shape of a frustum of a pyramid and having its vertex on the vertical axis of said ball-and-socket joint, each of the four faces of said pyramidal section of said operating button having raised pressing surfaces, said pressing surfaces engaging said rubber sheet at points by protruding through corresponding openings in said supporting plate when said operating button is tilted, the ball of said joint having pins crosswise of the vertical axis of said ball, the socket of said joint having grooves corresponding to said pins, said grooves being slightly narrower than the diameter of said pins, said pins and said grooves coacting to urge said operating button toward its untilted position.

2. A multi-position electrical switch comprising:

a housing an electrical insulating base plate disposed on the bottom of said housing printed circuit electrodes arranged on said base plate so that a pair of electrodes are respectively disposed on each side of a rectangle, a pressure-sensitive conductive rubber sheet laminated over the upper portion of said printed circuit electrodes and forming power source polarity changing switches by contacting and pressing said electrodes, a supporting plate of rectangular shape disposed over said rubber sheet, said supporting plate having a protruding ball at the center thereof and being perforated with openings of the same number as that of said switch elements, said openings being separated by diagonal members extending radially from the center of the surface of said plate, and an operating button disposed in a space surrounded by said housing on said supporting plate, said operating button having a socket forming a ball-and-socket joint upon engaging with the ball of said supporting plate, the bottom section of said operating button being in the shape of a frustum of a pyramid having a vertex on the vertical axis of said ball, and having four faces and four corner lines where said faces meet, the four faces of said frustum of a pyramid being provided with pressing surfaces protruding from the surface of each face which press against said rubber sheet upon engagement through said openings of said supporting plate by the pressing action when said operating button is depressed.

3. A switch as claimed in claim 2, wherein said supporting plate is provided with a pair of openings formed in the shape of a trapezoid symmetrical to each of the four sides of said plate, and said operating button is respectively provided with a pair of protruding pressing surfaces on each face of said frustum of a pyramid formed symmetrically in the shape of a trapezoid to engage said openings in said supporting plate.

4. A switch as claimed in claim 2, wherein a slide block type two button push button switch for change-over between a right-hand mirror and a left-hand mirror is provided on said housing.

5. A multi-position electrical switch comprising an electrical insulating base plate fixed contact components each consisting of a pair of printed circuit electrodes disposed on said insulating base plate so as to be opposed to each other.

a pressure-sensitive conductive rubber sheet laid over said fixed contact components, said fixed contact components and said pressure-sensitive conductive rubber sheet forming switch elements, a supporting plate disposed over said rubber sheet, having at the center thereof a ball of a ball-and-socket joint and having a plurality of openings therein, and an operating button for operating said switch elements, the lower section of said operating button having the shape of the frustum of a pyramid, said button being supported at its vertex on said ball of a ball-and-socket joint and being tiltable thereon with respect to said pressure-sensitive conductive rubber sheet, each of the four faces of said frustum of a pyramid having pressing surfaces corresponding to said openings in said supporting plate and each of said four faces corresponding to two of said switch elements, said switch elements forming two switch means for changing the polarity of the electric power source.

6. A multi-position electrical switch as claimed in claim 5, wherein the ball of said ball-and-socket joint is provided with pins crosswise of the vertical axis of said ball and the socket of said joint is provided with grooves being slightly narrower than the diameter of said pins, said pins and grooves co-acting to urge said operating button toward its untilted position.

* * * * *